United States Patent [19]

Allison

[11] 4,065,637

[45] Dec. 27, 1977

[54] ELECTRICAL CONNECTOR

[76] Inventor: Kenneth C. Allison, 1546 S. Shore Drive, Crystal Lake, Ill. 60014

[21] Appl. No.: 709,171

[22] Filed: July 27, 1976

Related U.S. Application Data

[63] Continuation-in-part of Ser. No. 393,601, Aug. 31, 1973, abandoned.

[51] Int. Cl.[2] ..... H01R 11/08; H01R 11/20

[52] U.S. Cl. ..... 174/87; 174/84 C; 339/97 C; 339/276 SF

[58] Field of Search ..... 339/97 R, 97 P, 97 C, 339/98, 99 R, 223, 276, DIG. 1; 174/84, 87, 88 R, 88 S, 90; 206/330, 460

[56] References Cited

U.S. PATENT DOCUMENTS

| | | | |
|---|---|---|---|
| 3,326,442 | 6/1967 | Fattor | 174/87 |
| 3,372,227 | 3/1968 | Allison | 174/87 |
| 3,507,977 | 4/1970 | Pusey | 339/DIG. 1 |
| 3,625,350 | 12/1971 | Ray | 339/97 C |
| 3,739,470 | 6/1973 | Eppler | 174/84 C |
| 3,868,475 | 2/1975 | Allison | 339/97 C |

*Primary Examiner*—Roy Lake
*Assistant Examiner*—Mark S. Bicks
*Attorney, Agent, or Firm*—Anthony S. Zummer

[57] ABSTRACT

The subject matter herein is an electrical connector particularly adapted for quickly and easily electrically and mechanically connecting insulated ends of a pair of insulated electrical wires. The subject connector includes an elongated penetrator tube, having a flared annular lip at one end. A groove is formed in the tube to provide a convenient means for holding the tube in an automatic assembly machine. The tube has a plurality of penetrator locks formed integral with side walls of the tube. Each of the locks has a plurality of penetrator prongs extending inwardly of the tube. One of the penetrator prongs in each of the locks is longer than the remainder of the prongs to provide a holding prong, which engages the insulating material as the wires are inserted into the tube to hold the wires in the tube prior to final locking. Each holding prong has a rounded side adjacent to the flared annular lip to facilitate insertion of insulated wires and avoid tearing of insulation and stubbing of the wires. A permanently deformable electrically-conductive sheath receives the tube. An insulator tube surrounds the sheath to insulate electrically the exterior of the sheath. When the connector is squeezed, the penetrator prongs penetrate the insulating material of the wire and electrically contact the electrical conductor so that the wires are mechanically gripped by the deformed tube and sheath, and are also electrically connected.

3 Claims, 20 Drawing Figures

ELECTRICAL CONNECTOR

CROSS-REFERENCE TO RELATED APPLICATION

This application is a continuation-in-part of U.S. Patent application Ser. No. 393,601, filed Aug. 31, 1973, for an ELECTRICAL CONNECTOR, now abandoned.

BACKGROUND OF THE INVENTION

Electrical connectors of the type in which insulated wire is inserted into a tube having prongs which penetrate the insulating material upon deformation of the tube to engage electrical conductors of the wire for simultaneous mechanical and electrical connection of the wires are well-known. There are many variations of these units. Typical of these electrical connectors are those disclosed in U.S. Pat. Nos. 3,283,061 and 3,372,227. As may be seen in both of the aforementioned patents, these electrical connectors are made up of three basic units, to-wit, the tube, which has a plurality of prongs for passing through an insulating material and engaging a wire; a sheath, which receives the tube and is deformed with the tube and generally keeps the tube in its deformed state; and an insulating material surrounding the sheath.

Generally, the electrical connectors are made by stamping out the tubes in a proper form; and also stamping out the sheaths in their proper form. The tubes are assembled by machine by inserting each tube in a sheath. The sheath and assembled tube are placed inside a tube of insulating material, which tube of insulating material is heated to shrink the insulating material onto the sheath. The assembled connectors are then ready to receive wires for connecting the wires to each other.

The electrical connectors of this general type are usually used in substantial quantities, so that it is necessary to manufacture and assemble the connectors at a minimum of cost. One of the problems which is encountered by the manufacturers of these electrical connectors is that there is a substantial amount of difficulty in assembling the connectors in a convenient fashion and assembling them in a proper orientation.

In certain applications, it is necessary to utilize connectors of this general type in a side-by-side arrangement, whereby two pairs of wires are connected. In the commercial application of devices wherein two pairs of wires are connected, it is often desirable to keep the two pairs of wires in their juxtaposed position for the purpose of tracing circuits and finding trouble spots. To this end, it is desirable to build an electrical connector which has the capability of securing to each other two pairs of wires. In connection with the utilization of connectors for connecting two pairs of wires, it is desirable to feed and store the electrical connectors in such a manner that the connectors may be readily fed into an automatic assembling device for automatically assembling two pairs of wires.

SUMMARY OF THE INVENTION

The subject matter of the instant invention is an improved electrical connector of the general type in which electrical wires are positioned in the connector; and the connector is then deformed to connect electrically the wires and for simultaneously holding the wires in mechanical connection.

Specifically, the present invention provides an improved construction wherein a tube carrying a plurality of penetrator prongs may be conveniently handled in automatic assembling machines, and that tubes may be readily and quickly inserted into a sheath. The connector also has an improvement in that the tube has a flared annular lip, which serves a multitude of purposes. A groove is formed in the tube adjacent to the lip. The outer portion of the flared lip is used for aligning the tubes in an automatic handling machine, so that all of the tubes are properly aligned. The groove provides an appropriate means for holding the tube. The tubes are easily inserted into their respective sheaths. The construction is such that the outer portion of the flared lip also serves as a press fit for holding the tube in the sheath. The flared lip also provides an opening which facilitates the insertion of a pair of insulated electrical wires into the connector.

The construction of the electrical connector includes a specific construction for alignment of penetrator locks. Each of the penetrator locks includes four penetrator prongs. One of the prongs of each of the locks is longer than the other prongs, so that each of the longer prongs acts as a holding prong. Each of the holding prongs is formed in the forming operation to have a rounded edge facing the flared lip of the tube. Thus, the insulated wires may be pushed into the connector with facility. However, retraction of the wires is impeded since the insulating material then engaged the holding prong, which is sharp on the back side of the prong. Thus, the wires are initially held prior to deformation of the connector.

The present invention also provides one form of the improvement wherein two pairs of electrical wires may be electrically connected; and the wires are held juxtapositioned. Each of the connectors which holds two pairs of wires has an insulating portion, which receives a pair of sheaths which are electrically insulated from each other. Each of the sheaths receives a tube, which is mounted in the sheath so that, when the two pairs of wires are mounted in their respective sheaths, the sheaths may be crimped to hold the two wires together. The insulating material serves the dual function of holding the pairs of wires together and insulating their respective sheaths.

An insulating supply unit is also provided, wherein electrical connectors are adhesively secured to an elongated member for storage so that the electrical connectors may be delivered to a machine and readily removed out of storage for use.

It is therefore a principal object of the instant invention to provide an electrical connector which may be easily and conveniently manufactured and assembled on automatic machinery.

It is another object of the present invention to provide an electrical connector which has an improved construction for holding electrical wires prior to deformation of the electrical connector for permanent holding of electrical wires.

It is a still further object of this invention to provide an improved construction for an electrical connector which may be economically manufactured and easily assembled and used.

It is another object of the herein-disclosed invention to provide an electrical connector which may hold two pairs of insulated wires in close mechanical proximity but being electrically insulated from each other.

It is still another object of this invention to provide a supply unit for providing electrical connectors for use in an automatic assembling machine, whereby the electrical connectors are easily and quickly applied to insulated electrical wires for mechanically holding and electrically connecting those wires.

Other objects and uses of the instant invention will become readily apparent to those skilled in the art upon a perusal of the following specification in light of the accompanying drawing.

DESCRIPTION OF THE PREFERRED EMBODIMENT

Figures 1, 2, 3, 4, 5, 6, 7, 8, 9:
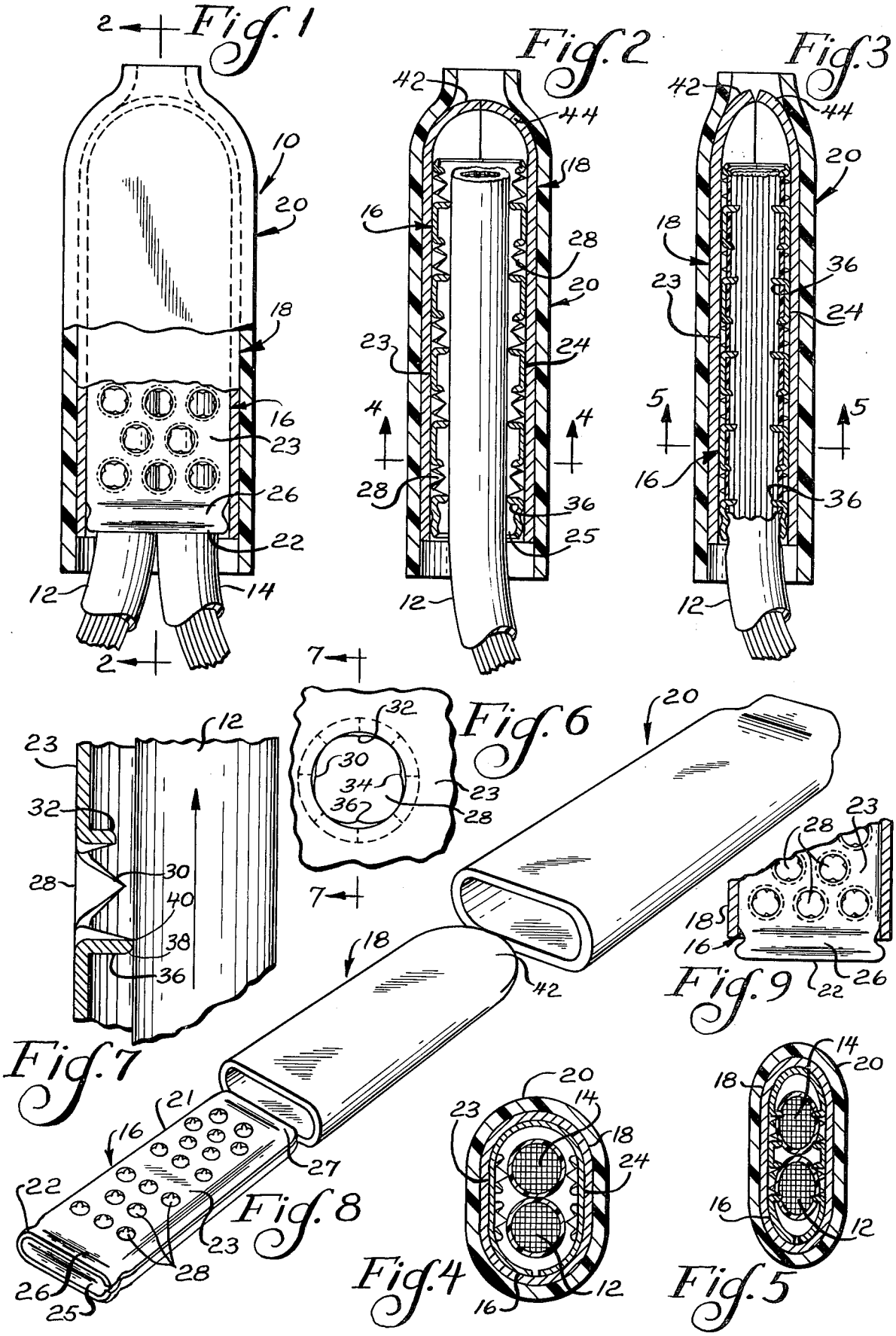
FIG. 1 is a side elevational view of an electrical connector embodying the present invention, shown with two insulated electrical wires positioned therein and with portions of the electrical connector broken away in order to show better the interrelationship of the various parts of the connector.
FIG. 2 is a cross-sectional view taken on line 2—2 of FIG. 1.
FIG. 3 is a cross-sectional view similar to FIG. 2, but showing the connector in a deformed state wherein electrical wires are held in the connector, with portions of insulation and other portions of the connector broken away in order to show the interrelationship of the various parts.
FIG. 4 is a cross-sectional view taken on line 4—4 of FIG. 2.
FIG. 5 is a cross-sectional view taken on line 5—5 of FIG. 3.
FIG. 6 is an enlarged plan view of a portion of a penetrator tube, which tube constitutes a portion of the electrical connector, and which view shows an aperture defined by a penetrator lock and portions of the penetrator lock.
FIG. 7 is a cross-sectional view taken on line 7—7 of FIG. 6, showing a portion of a holding prong of a penetrator lock in engagement with an insulated wire.
FIG. 8 is an exploded view of the electrical connector of FIG. 1, showing the general relationship of the various parts of the electrical connector prior to assembly.
FIG. 9 is a fragmentary portion of a tube and a sheath of the electrical connector of FIG. 1, showing the interrelationship of a portion of the tube relative to the sheath prior to completion of assembly.

Referring now to the drawing, and especially to FIG. 1, an electrical connector generally indicated by numeral 10 is shown therein, with a pair of conventional insulated wires 12 and 14 positioned in the electrical connector 10. The electrical connector 10 generally consists of a penetrator tube 16 for receiving the wires 12 and 14, a permanently deformable electrically-conductive tubular sheath 18 receiving said tube 16, and an insulator tube 20 receiving the sheath 18. In this instance, the insulator tube is polyethylene, though any other suitable heat-shrinkable material may be used.

The penetrator tube generally consists of a body, having a cylindrical side wall 21, with a flared outer annular lip 22 formed integral with one end thereof. The cylindrical side wall has substantially straight sides and has a general oblong cross-section, as may be best seen in FIGS. 4 and 8. The side wall 21 has a pair of opposed generally flat sides 23 and 24, which are substantially parallel to each other. The outwardly-extending lip 22, formed integral with one end of the cylindrical side wall 21, defines a mouth 25 at that end of the body. A groove 26 is formed in the body adjacent to the lip, which groove circumscribes the body. The other end of the body has tapered ring 27 formed integral therewith to define an inwardly curved interior end.

A plurality of penetrator locks 28 is formed integral with each of the flat sides 23 and 24. The penetrator locks 28 are formed on opposite sides of the cylindrical side walls 21, for reasons which will become apparent hereinafter. The construction of penetrator lock 28 is best shown in FIGS. 6 and 7. As may be seen in FIG. 6, each penetrator lock 28 includes four equiangularly spaced penetrator prongs 30, 32, 34 and 36, each of which prongs is formed integral with the side wall 21. The penetrator prongs 30, 32, 34 and 36 extend inwardly of the tube; and the end of each of the prongs is perpendicular to the respective portion of side wall 21. As may be seen in FIG. 6, prongs 30, 32 and 34 are equiangularly spaced; and the angular displacement from prong 36 to prongs 30 and 34 is greater than the angular displacement between the other prongs.

The penetrator prong 36 of each lock is a holding prong, and has a strength greater than the remaining three prongs. The holding prong 36 is positioned adjacent to the mouth 25 of the tube relative to the other three penetrator prongs. Each prong 36 is resiliently displaceable by a wire to facilitate insertion of the wires. The holding prong also has a rounded surface 38 on the side adjacent to the mouth 25. This rounded surface terminates at a sharp point 40, so that insulation of one of the wires may readily pass inwardly past the penetrator prong but is held in the penetrator tube against removal therefrom.

In this instance, the penetrator tube is made of a relatively thin piece of phosphor bronze, which is wiped with tin. It is apparent that any other suitable material may be used also. The penetrator tube is formed by a stamping operation, as is described below. The side walls are thin; and the penetrator prongs are also relatively thin to facilitate insertion of the prongs into insulating material and into engagement with the electrical conductor of the wire.

The sheath 18 is formed of a single piece of red brass sheet material, and formed into a shape having a generally elliptical cross-section, as seen in FIG. 4, having one end closed. The elliptical cross-section is similar to the exterior of the penetrator tube 16, so that the sheath mateably receives the penetrator tube 16. The sheath has one end closed by a pair of lips 42 and 44. The other end of the sheath is open. The opening in the open end of the sheath is symmetrical with the outer periphery of the annular lip of its respective penetrator tube; but the opening is slightly smaller to provide an interference fit therebetween, so that the lip resiliently engages the interior of the sheath.

Figure 10:
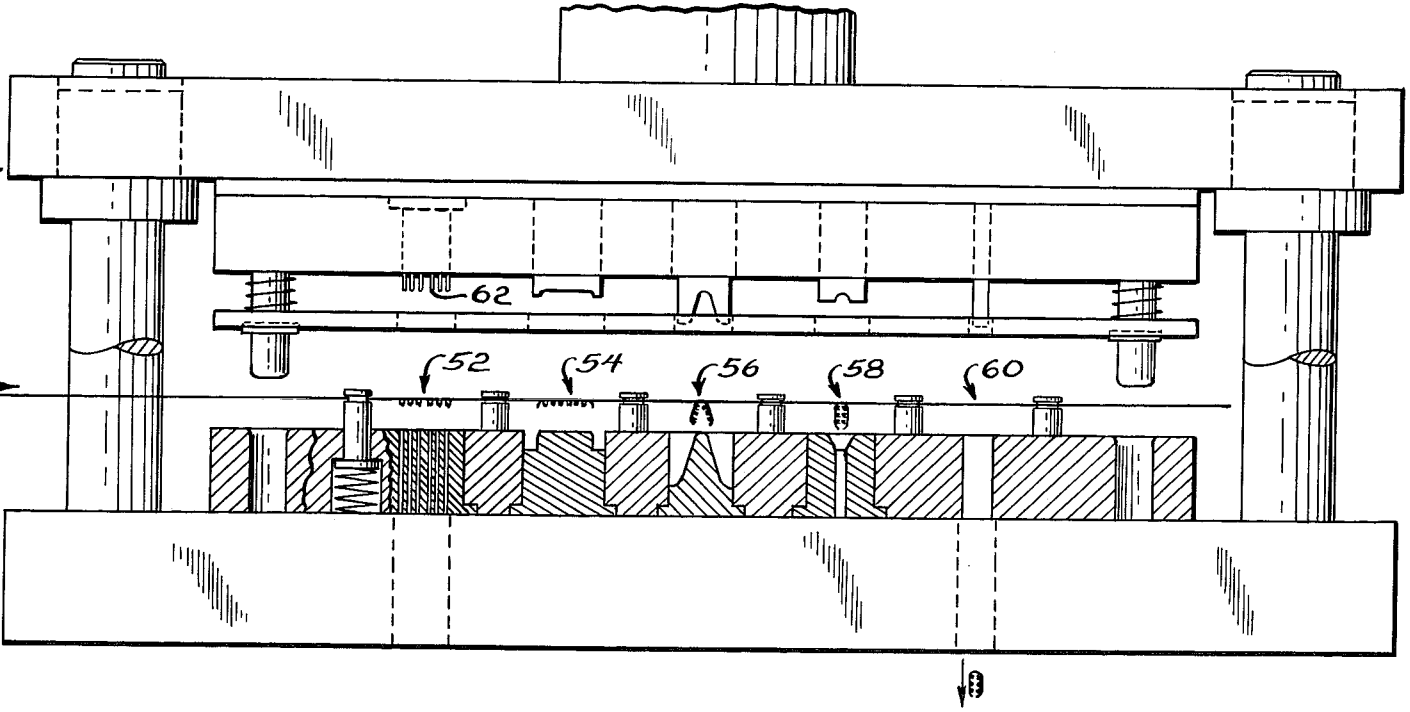
FIG. 10 is a side elevational view, with a portion in cross-section, of a die used in the manufacture of the tube of the electrical connector.

The penetrator tube is stamped out of a piece of relatively thin phosphor bronze strip 48, which is shown in end view in FIG. 10. The tube is formed on a conventional progressive die set 50, which is also shown in FIG. 10, with portions of the forming die broken away to show better the construction thereof. It may be seen that the tube is formed in five stages, the first of which is indicated at numeral 52, wherein the penetrator prongs are formed into the tube. The tube is then further formed in a second stage 54; and the tube takes on a further shape at a third stage 56. The tube is then substantially completed at a fourth stage 58, wherein opposed edges of the tube are placed in juxtaposition to complete the cylindrical side wall 21. At a fifth stage 60, the tube is released from the strip and delivered for use.

Figure 16:
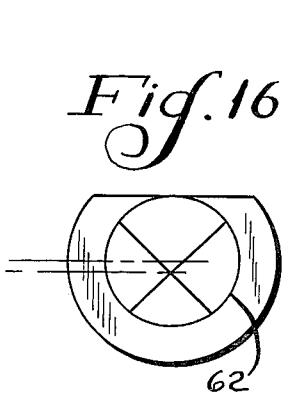
FIG. 16 is a bottom view of the punch of FIG. 14.
Figure 15:
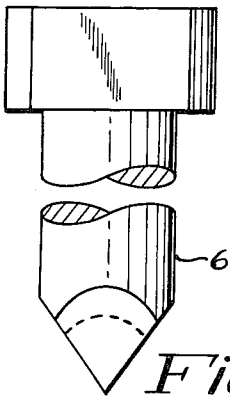
FIG. 15 is an end elevational view of the punch of FIG. 14.
Figure 14:
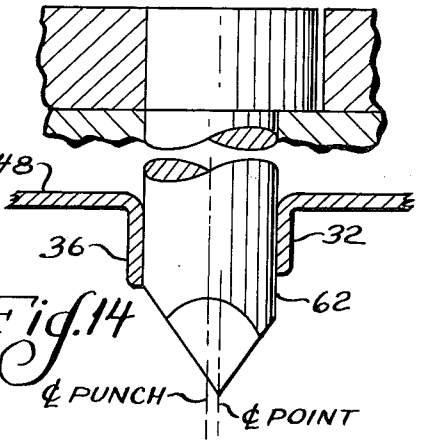
FIG. 14 is a side elevational view of a portion of a punch used for punching out a penetrator lock.
Figure 13:
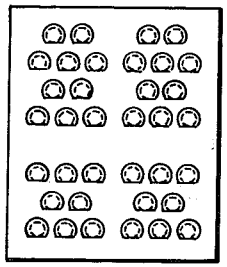
FIG. 13 is a view of a flat section of the die of FIG. 10, showing a guide for punches used in the die.
Figure 11:
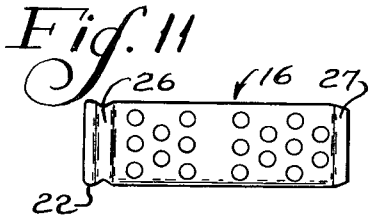
FIG. 11 is a plan view of a tube, which constitutes a portion of the electrical connector.
Figure 12:
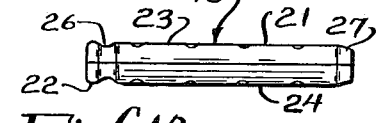
FIG. 12 is a side elevational view of the tube shown in FIG. 1.

FIG. 14 is an enlarged fragmentary detailed side elevational view of a portion of a punch 62, which forms one of the penetrator locks. In FIG. 14, the punch 62 is shown penetrating strip 48 to form the holding prong 36 and the other penetrator prongs of a penetrator lock. FIG. 15 shows an end elevational view of the punch. FIG. 16 is a bottom view of the punch, showing the displacement of the point of the punch from the center thereof to form the elongated holding prong 36.

It may be appreciated that the penetrator tubes leaving the die set fall in a random manner, so that it is necessary to align the penetrator tubes. The flared lip of each tube provides the means for aligning the tube. The groove on each of the penetrator tubes provides the operative portion of the tube for holding the tube in an aligned attitude with the other tubes in a conventional assembly machine for insertion of the tube into its respective sheath.

As was mentioned above, the sheath has one end closed; and the other end is open. The construction of the sheath allows for easy alignment of the sheath. Once the sheaths are aligned and the penetrator tubes are also carried into alignment, the penetrator tubes are positioned in their respective sheaths. The inwardly-curved end of the penetrator tube facilitates the insertion of the penetrator tube into its respective sheath. It is important to note that the tapered ring eliminates any hang-ups of the penetrator tubes in the insertion of the tube into the sheath. The tapered ring also allows for minor misalignments to occur in the assembly machine and still have proper insertion of the tube into the sheath. As the penetrator tube is moved forward into the sheath, the penetrator tube approaches the bottom of its respective sheath until the position of the penetrator tube relative to the sheath is such as that shown in FIG. 9, wherein the annular lip 22 extends beyond the interior wall of the sheath. The tube is forced into the sheath, so that the annular lip frictionally engages the sheath to hold the sheath and the tube together, with the tube centered in the sheath since the annular lip extends outward from the entire periphery of the tube. The sheath, with the tube mounted in it, is then positioned in the polyethylene insulator tube. The entire assembly is heated to heat-shrink the insulator tube onto the sheath.

The completed electrical connector may then be used for connecting the insulated wires 12 and 14. The insulated wires are positioned in the penetrator tube; and are forced inwardly of the tube. It is important to note that the wires, moving inwardly, ride on the rounded edges of the holding prongs 36. The holding prongs keep the insulation away from the remainder of the penetrator prongs, which do not have rounded edges facing the movement of the wire. It should further be noted that the holding prongs do not allow any hang-ups to occur in view of the fact that it is the rounded edge of the holding prong which faces the insulating material on the wire. Thus, the wire readily rides over the holding prong, and does not have an opportunity to catch on the sharp edge of the other prongs.

Once the wires are in place within the holding prong in substantially the attitude shown in FIG. 2, an appropriate force is applied to opposite sides of the electrical connector to squeeze the insulating tube, sheath and penetrator tube together. The penetrator prongs extend through the insulation of the wire to contact the conductor portion of the wire. The holding prongs come in contact with the wire to provide electrical connection therewith. In view of the fact that the sheath is a relatively soft material, the sheath is permanently deformed, holding the penetrator prong in tight engagement with the wire. It may be appreciated that there is a good electrical connection between the two wires through the penetrator prong and the sheath. The insulator tube insulates the exterior of the sheath. Furthermore, the holding prongs provide an improved holding of the wire, so that the wire may not be pulled out of the electrical connector. The improved holding occurs in view of the fact that the holding prongs are all adjacent to the mouth, so that the force required for pulling the wire out of the electrical connector requires further deformation of the holding prong.

Figure 17:
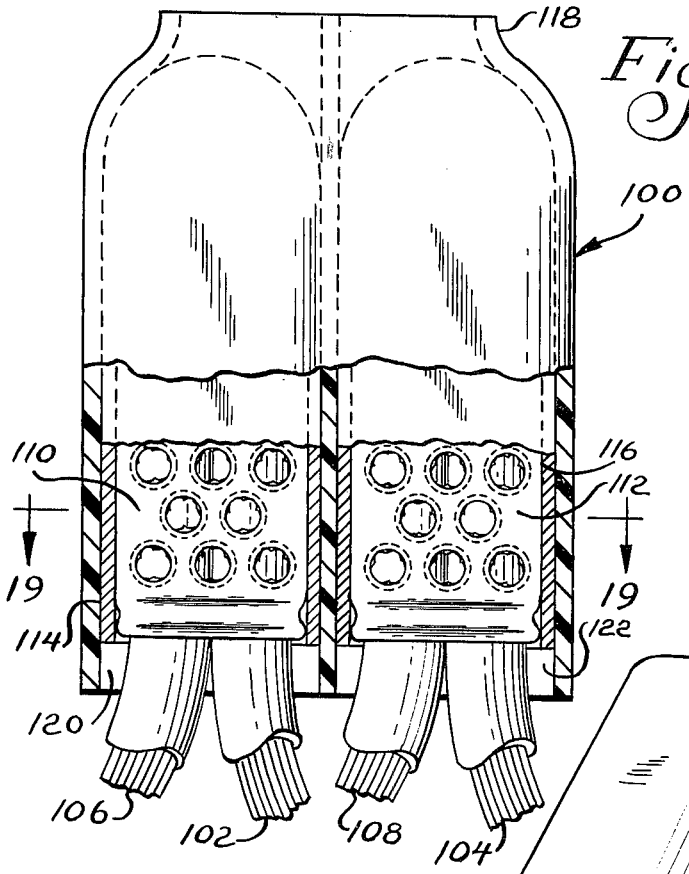
FIG. 17 is a side elevational view of an electrical connector embodying the present invention, shown with two pairs of insulated electrical wires positioned therein, with portions of the electrical connector broken away in order to show better the interrelationship of the various parts of the connector.
Figure 20:
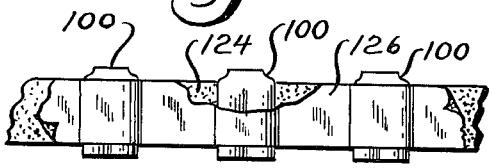
FIG. 20 is a plan view of a portion of a support unit embodying the herein-disclosed invention, with portions broken away in order to show better the construction thereof.
Figure 18:
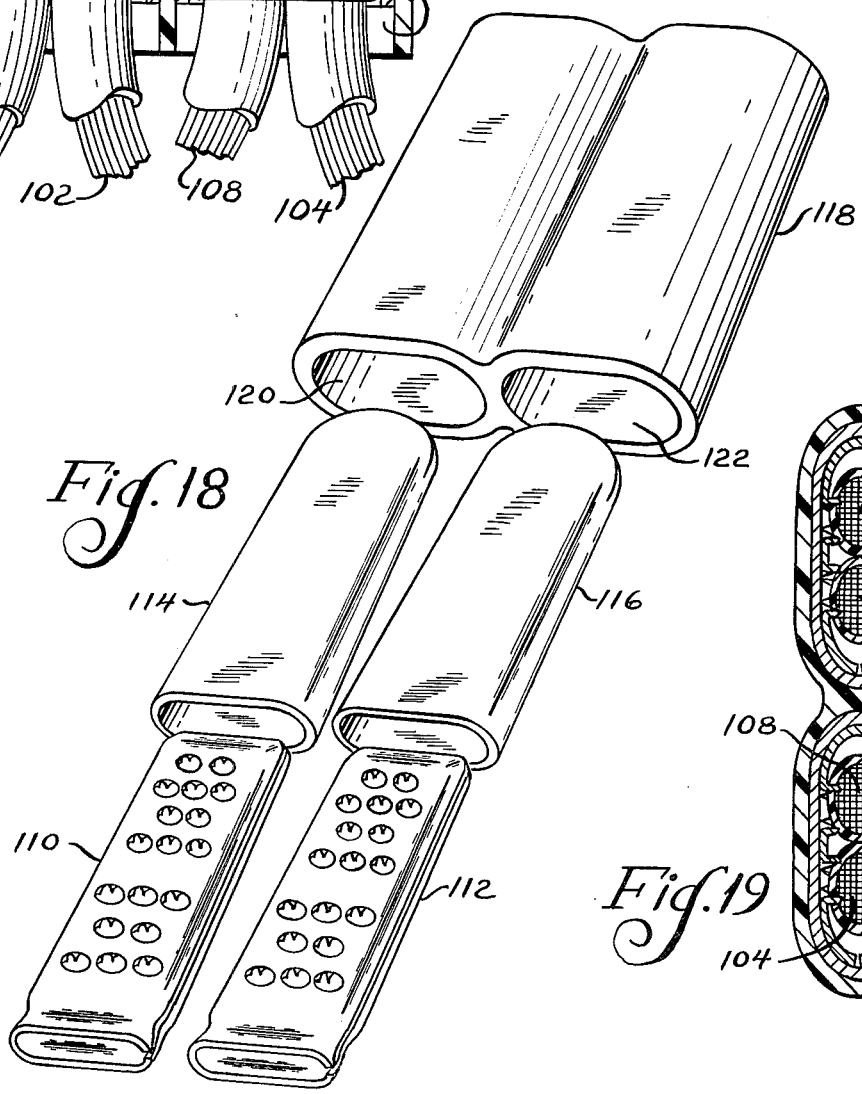
FIG. 18 is an exploded view of the electrical connector of FIG. 17, showing the general relationship of the various parts of the electrical connector prior to assembly.
Figure 19:
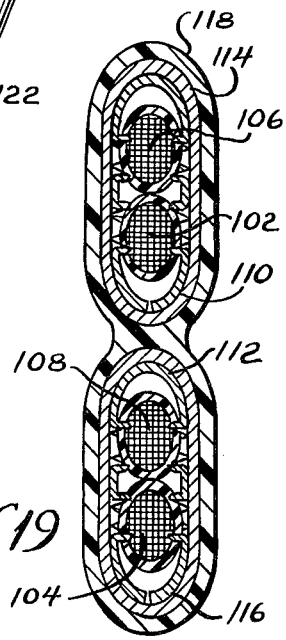
FIG. 19 is a cross-sectional view of the electrical connector of FIG. 17, taken on line 19—19 of FIG. 17.

Turning now to FIG. 17, an electrical connector generally indicated by numeral 100 is shown therein, which connector electrically connects and holds two pairs of insulating wires. A pair of wires 102 and 104 is shown electrically connected to a second pair of wires 106 and 108, respectively. The wires are conventional insulated wires.

The electrical connector 100 generally consists of a pair of penetrator tubes 110 and 112, which are identical in construction to the penetrator tube 16 described in detail above. The penetrator tubes 110 and 112 are mounted in sheaths 114 and 116, respectively. The sheaths 114 and 116 are identical to the permanently deformable electrically-conductive tubular sheath 18 described in detail above. The sheaths 114 and 116 are mounted in an insulator tube 118. The insulator tube 118 has a pair of apertures 120 and 122, which receive the sheaths 114 and 116, respectively. The insulator tube 118 is made of the same heat-shrinkable polyethylene material which is described in connection with insulator tube 20.

The tubes 110 and 112 are made in the same manner as the penetrator tube 16, described above. The penetrator tubes 110 and 112 are mounted in their respective sheaths 114 and 116 in the same manner as that described above. When the penetrator tubes are assembled in their respective sheaths, the sheaths 114 and 116 are positioned in their respective openings 120 and 122 in insulator tube 118. The insulator tube is heated to shrink the tube onto the sheaths, so that the sheaths are held within the tube; and the pairs of sheaths are held next to each other.

The assembled electrical connector 100 is delivered from an assembling machine onto a loading machine, where the electrical connectors 100 are mounted in position between a pair of adhesive tapes 124 and 126. The electrical connectors 100 are mounted on the tapes in an aligned attitude, that is, all of the electrical connectors are parallel to each other and all of the mouths face in the same direction. The electrical connectors are spaced in appropriate position for a given application.

When the electrical connectors 100 are used, the electrical connectors are delivered to an appropriate assembling machine, at which point the wires 102 and 106 are inserted into tube 110, and wires 104 and 108 are inserted into tube 112. The manner of insertion is the same as that described in detail above. A force is then applied to opposite sides of the electrical connectors to force the penetrator prongs to penetrate the insulation and contact to conductive portion of the electrical wire. The wires are then electrically connected and mechanically held together. It is important to note that the pairs of wires are held permanently next to each other. There is a substantial advantage in being able to hold the wires next to each other in many operations. In many instances where a mechanic needs to trace a circuit, the holding of the wires adjacent to each other facilitates tracing of the circuit; and thereby aids in the easy repair of a particular installation.

Although a specific embodiment of the present invention has been described in detail above, it is readily apparent that those skilled in the art may make various modifications and changes in the construction of the connector and may substitute materials for those described herein without departing from the spirit and scope of the present invention. It is to be expressly understood that the instant invention is limited only by the appended claims.

What is claimed is:

1. An electrical connector particularly adapted for mechanically holding and electrically connecting insulated ends of insulated wires and being particularly adapted for assembly in an automatic assembling machine, including: an elongated conductive resilient penetrator tube having a cylindrical body, having a pair of opposed sides, formed of a single thin sheet folded on itself, with opposed edges in abutting juxtaposition, an outwardly flared annular lip formed integral with one end of the body, said annular lip defining a mouth for said end of the body to receive insulated ends of insulated electrical wire, an annular groove in the body circumscribing said body at the one end adjacent to the lip to provide a convenient means for handling the tube in an automatic assembling machine, a plurality of penetrator locks formed integral with each of opposite sides of the body, each of said penetrator locks on one of the sides of the body extending inwardly of the body toward the opposite side of the body, each of said penetrator locks including four relatively thin penetrator prongs for penetration through insulating material on a wire and into engagement with a conductive portion of the wire to provide electrical connection thereto, each of the penetrator locks including as one of the plurality of penetrator prongs a resilient holding prong being perpendicular to its respective portion of the side of the body and having a length greater than the other penetrator prongs, said holding prong being positioned adjacent to the lip relative to the other penetrator prongs of the respective penetrator lock, each of the holding prongs is spaced from adjacent groups of the respective penetrator lock a greater angular distance than the angular distance between the other prongs of the respective penetrator lock, each of the holding prongs having a rounded side adjacent to the lip and being resiliently displaceable from the perpendicular to facilitate insertion of the insulated wires into the tube but holding the wire away from the other penetrator prongs during insertion while the wire rides into the tube of the respective rounded sides of the holding prongs whereby the holding prong holds the insulated wire away from the penetrator prongs while the wire is being inserted into the tube and crimping of the tube forces the holding prong to enter the insulating material of the wire substantially perpendicular to the wire and to force the penentrator prongs through the insulating material into contact with a conductive portion of the wire; a permanently deformable electrically-conductive tubular sheath mateably and slideably receiving said conductive penetrator tube, said sheath having one end open, said opening of the sheath being symmetrical with the outer periphery of the outwardly flared annular lip; and an insulator tube surrounding the deformable sheath, whereby application of sufficient force to opposite sides of the insulating tube deforms the deformable sheath and the penetrator tube to force penetrator prongs through the insulating material of a pair of insulated ends of insulated electrical wires positioned in the penetrator tube and into electrical contact with the electrical wires, the permanently deformable sheath holds the prongs of the penetrator tube in contact with the wires and the conductive penetrator tube and the conductive sheath provides electrically-conductive paths between the wires held in the penetrator tube while the insulated tube electrically inslates the exterior of the permanently deformable sheath.

2. An electrical connector adapted for mechanically holding two pairs of insulated wires and electrically connecting insulated ends of the wires in each of the pairs and being particularly adapted for assembly in an automatic assembling machine, including: a pair of elongated conductive resilient penetrator tubes, each of the penetrator tubes having a cylindrical body, including a pair of opposed sides formed of a single thin sheet folded on itself, with opposed edges of the sheet in abutting juxtaposition, an outwardly flared annular lip formed integral with one end of each body, each lip circumferentially extending outwardly beyond its respective body, each annular lip defining a mouth for the one of its respective body to receive insulated ends of insulated electrical wire, a groove in each body circumscribing that body at the one end adjacent to the respective lip to provide a convenient means for handling the tube in an automatic assembling machine, a plurality of penetrator locks formed integral with each of opposed sides of each body, the penetrator locks on each of the sides of each of the bodies extending inwardly of the respective body toward the opposite side of that body, each of the penetrator locks including a plurality of relatively thin penetrator prongs for penetration through insulating material on a wire and into engagement with a conductive portion of the wire to provide electrical connection thereto, each of the penetrator locks including as one of the plurality of penetrator prongs a resilient holding prong, perpendicular to its respective portion of the side of the body and having a length greater than the other penetrator prongs, said resilient holding prong positioned adjacent to the lip relative to the other penetrator prongs of the respective penetrator lock, each of the holding prongs is spaced from adjacent prongs of the respective penetrator lock a greater angular distance than the angular distance between the other prongs of the respective penetrator lock, each of the holding prongs of the respective penetrator lock, each of the holding prongs having a rounded side adjacent to the lip and being resiliently displaceable from the perpendicular to facilitate insertion of the insulating wires into the tube but holding the wire away from the other penetrator prongs during insertion while the wire rides into the tube on the respective rounded sides of the holding prongs; a permanently deformable electrically-conductive tubular sheath mateably and slideably receiving each of said conductive penetrator tubes, each of said sheaths having oe end closed and the other end open, the opening of the sheath at the other end being symmetrical with the outer periphery of the outwardly flared annular lip of its respective tube; and a heat-shrinkable insulator tube, having a pair of spaced parallel pockets, each of said pockets receiving one of the sheaths for holding the sheaths and the respective penetrator tube.

3. A supply unit for providing in a selected spaced relationship a plurality of electrical connectors, which connectors are adapted for mechanically holding two pairs of insulated wires and electrically connecting insulated ends of each of the pairs of insulated electrical wires, including: an elongated strip of adhesive material; a plurality of electrical connectors adapted for mechanically holding two pairs of insulated electrical wires and electrically connecting insulated ends of wires in each of the pairs, removably mounted on said strip; each of said electrical connectors being parallel to an adjacent electrical connector; each of said electrical connectors having a pair of openings at one end and said ends of the electrical connectors being aligned; and each of said electrical connectors including; a pair of elongated conductive resilient penetrator tubes, each of said tubes having a cylindrical body, including a pair of opposed sides formed of a single thin sheet folded on itself, with opposed edges of the sheet in abutting juxtaposition, an outwardly flared annular lip formed integral with one end of each body, each of said lips circumferentially extending outwardly beyond its respective body, each annular lip defining a mouth for the end of its respective body to receive insulated ends of insulated electrical wire, a groove in each body circumscribing that body at the one end adjacent to the respective lip to provide a convenient means for handling the tube in an automatic assembling machine, a plurality of penetrator locks formed integral with each of opposed sides of each body, each penetrator lock on each of the sides of each body extending inwardly of the body toward the opposite side of the body, each of the penetrator locks including a plurality of relatively thin penetrator prongs for penetration through insulating material on a wire and into engagement with a conductive portion of the wire to provide electrical connection thereto, each of the penetrator locks including as one of the plurality of penetrator prongs a resilient holding prong perpendicular to its respective portion of the side of the body and having a length greater than the other penetrator prongs, said resilient holding prong positioned adjacent to the lip relative to the other penetrator prongs of the respective penetrator lock, each of the holding prongs is spaced from adjacent prongs of the respective penetrator lock a greater angular distance than the angular distance between the other prongs of the respective penetrator lock, each of the holding prongs having a rounded side adjacent to the lip and being resiliently displaceable from the perpendicular to facilitate insertion of the insulating wires into the tube but holding the wire away from the other penetrator prongs during insertion while the wire rides into the tube on the respective rounded sides of the holding prongs; a permanently deformable electrically-conductive tubular sheath mateably and slideably receiving each of said conductive penetrator tubes, each of said sheaths having one end closed and the other end open, the opening of the sheath at the other end being symmetrical with the outer periphery of the outwardly flared annular lip of its respective tube; and a heat-shrinkable insulator tube having a pair of spaced parallel pockets, each of said pockets receiving one of the sheaths for holding the sheaths and the respective penetrator tube.

* * * * *

UNITED STATES PATENT OFFICE

CERTIFICATE OF CORRECTION

PATENT NO. : 4,065,637

DATED : December 27, 1977

INVENTOR(S) : Kenneth C. Allison

It is certified that error appears in the above-identified patent and that said Letters Patent are hereby corrected as shown below:

Column 2, Line 4, "tubes" should be --tube--.

Column 7, Line 29, "to" should be --the--.

Column 8, Line 19, "of" should be --on--.

Column 8, Line 45, "inslates" should be --insulates--.

Column 8, Line 60, after "one" insert --end--.

Column 9, Lines 16 and 17, cancel "each of the holding prongs of the respective penetrator lock,".

Column 9, Line 27, "oe" should be --one--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*